United States Patent [19]

Lang

[11] 4,120,491

[45] Oct. 17, 1978

[54] SHEET STACKING APPARATUS

[75] Inventor: Hans Friedrich Lang, Landau, Germany

[73] Assignee: Gustav Weyland KG, Landau, Pfalz, Germany

[21] Appl. No.: 801,071

[22] Filed: May 27, 1977

[30] Foreign Application Priority Data

Jun. 19, 1976 [DE] Fed. Rep. of Germany ... 7619535[U]

[51] Int. Cl.[2] ..... B65H 29/58

[52] U.S. Cl. ..... 271/64; 271/178; 271/187

[58] Field of Search ..... 271/64, 80, 177, 178, 271/186, 187, DIG. 2

[56] References Cited

U.S. PATENT DOCUMENTS

| | | | |
|---|---|---|---|
| 3,162,438 | 12/1964 | Perry | 271/187 |
| 3,347,367 | 10/1967 | Smith | 271/187 X |
| 3,487,447 | 12/1969 | Fusco | 271/64 |
| 3,851,773 | 12/1974 | Kluge | 271/64 X |

FOREIGN PATENT DOCUMENTS

| | | | |
|---|---|---|---|
| 355,162 | 8/1961 | Switzerland | 271/187 |

*Primary Examiner*—Richard A. Schacher
*Attorney, Agent, or Firm*—Kurt Kelman

[57] ABSTRACT

Sheets coming from a rotary printing press are conveyed to a drum mounted for rotation adjacent the delivery end of the sheet conveyor band. The drum comprises a plurality of like axially spaced discs, each disc having a series of spirally extending, equidistant pockets distributed uniformly about the periphery thereof. Each pocket defines an inlet opening for receiving a sheet as the drum rotates successive inlet openings into sheet receiving relationship with the delivery end. Strippers are mounted peripherally spaced from the delivery end at a sheet stacking station between the discs of the drum to strip the sheets from the pockets and stack them.

2 Claims, 4 Drawing Figures

SHEET STACKING APPARATUS

The present invention relates to an apparatus for stacking sheets in a rotary printing press wherefrom a conveyor band means conveys successive sheets to a delivery end thereof.

In known stacking apparatus of this type, the cut sheets are conveyed between two cooperating conveyor bands to a stacking device which consists of a further conveyor band mounted below the cooperating conveyor bands, the conveyed sheets being deposited by gravity on the further conveyor band. The drive for this further conveyor band may be adjusted to the desired formation of the stack, various devices and braking means being used to provide a scales stack of sheet. The conveyor speed of the cooperating conveyor bands must be limited to avoid damage to, or bending of, the sheets.

It is the primary object of this invention to provide a sheet stacking apparatus of considerably increased efficiency.

This and other objects are accomplished according to the invention with a sheet receiving drum mounted for rotation adjacent the delivery end of the conveyor band means which conveys successive sheets to the delivery end. The drum comprises a plurality of like axially spaced discs, each disc having a series of spirally extending, equidistant pockets distributed uniformly about the periphery thereof, each pocket defining an inlet opening for receiving a respective one of the sheets from the delivery end as the drum rotates successive ones of the inlet openings into sheet receiving relationship with the delivery end, the inlet openings of the pockets of all discs being in alignment. Stripper elements are mounted peripherally spaced from the delivery end of the conveyor band means at a sheet stacking station and extend between the discs of the sheet receiving drum whereby an inner end of each successive sheet is stopped by the stripper elements as the drum rotates and brings the inner sheet end into engagement with the stripper elements and further rotation of the drum strips the successive sheets out of the pockets wherein they have been received and stacks the successive sheets.

This arrangement almost triples the efficiency of stacking and, additionally, assures trouble-free stacking of the successive sheets without danger of damage or bending. Furthermore, the apparatus may also be used for thin sheets since such sheets are conveyed after cutting between the cooperating conveyor bands to the sheet receiving drum and are then automatically stripped therefrom at the stacking station.

In accordance with the present invention, sheet guide elements surround a portion of the periphery of the drum and extend to the delivery end of the conveyor band means, ending before the stacking station to enable the successive sheets to fall from their pockets. Such sheet guide elements will hold the sheets from end to end in the pockets during the rotation of the drum to transport the sheets securely in the pockets from the delivery end to the stacking station, thus preventing the sheets from being thrown out of the pockets, particularly at high rotary speeds of the drum.

The above and other objects, advantages and features of this invention will become more apparent from the following detailed description of certain now preferred embodiments thereof, taken in conjunction with the accompanying drawing wherein FIG. 1 is a vertical section showing the stacking apparatus and, more particularly, its sheet receiving drum mounted between the delivery end of the sheet conveyor band means and the sheet stacking station;

Figure 1:
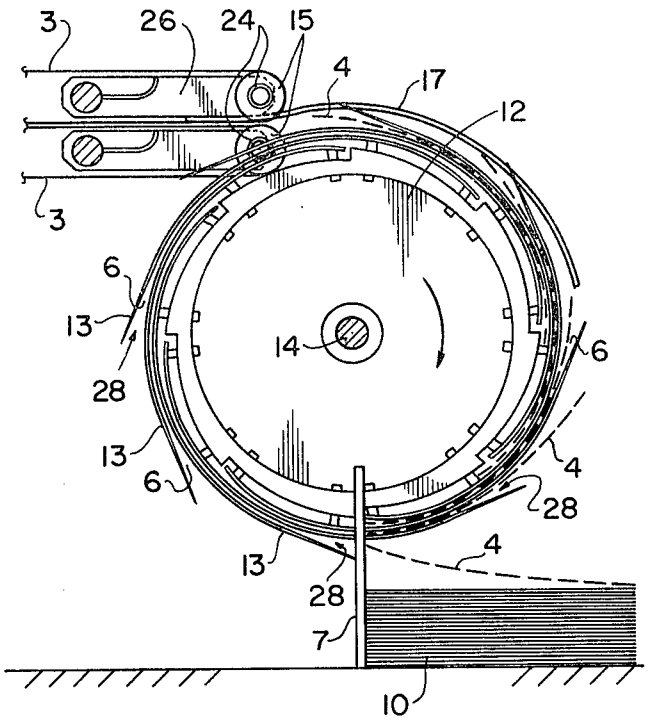
Figure 2:
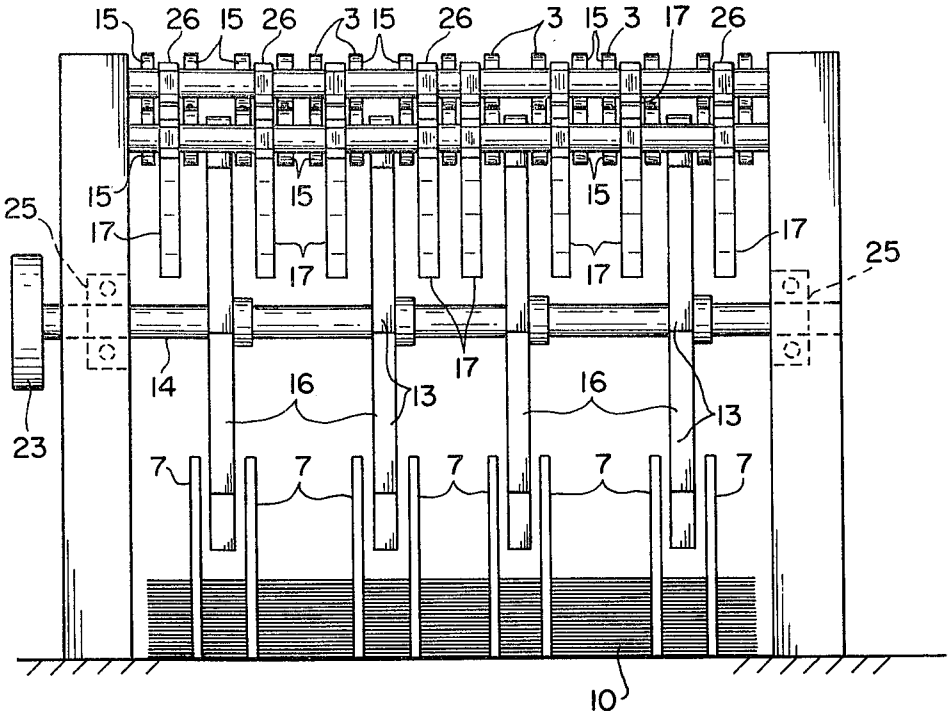
FIG. 2 is a side elevational view of FIG. 1.

Referring now to FIGS. 1 and 2, the illustrated apparatus for stacking paper sheets 4 coming from a rotary printing press (not shown) comprises a conveyor band means consisting of a pair of cooperating endless conveyor bands 3 trained over rollers 15 at a delivery end thereof for conveying successive sheets 4 to the delivery end. Sheet receiving drum 12 is mounted for rotation adjacent the delivery end of the conveyor band means.

The drum comprises a plurality of like axially spaced discs 16, the discs being mounted on rotary drive shaft 14 journaled in bearings 25 and driven by a suitable drive 23. Each disc has bolted thereto a series of spirally extending, equidistant pockets 6 distributed uniformly about the periphery thereof. Each pocket 6 defines inlet opening 28 for receiving a respective one of sheets 4 from the delivery end as the drum rotates in the direction indicated by the arrow in FIG. 1 to bring successive inlet openings into sheet receiving relationship with the delivery end. As clearly shown in FIG. 2, the inlet openings of the pockets of all discs are in alignment so that the aligned pockets of all the discs form a single pocket means for each sheet. As shown in FIG. 1, sheet guide element 13 extends outwardly and tangentially to the drum at each inlet opening 28 of the pockets, the successive sheets being received tangentially from the delivery end of conveyor bands 3 at discharge rollers 15 and being guided into pockets 6 by the tangentially extending guide elements 13.

A series of rectilinearly aligned stripper elements 7 are peripherally spaced from the delivery end of conveyor bands 3 at sheet stacking station 10. The stripper elements extend like fingers between discs 16 (see FIG. 2) whereby an inner end of each successive sheet 4 is stopped by the aligned stripper elements (see FIG. 1) as drum 12 rotates and brings the inner sheet end into engagement with the stripper elements. Further rotation of the drum in a clockwise direction strips the successive sheets out of pockets 6 wherein they have been received and carried, and stacks the successive sheets at station 10 one on top of another. In other words, stripper elements 7 automatically stack sheets 4 and, as shown in FIGS. 3 and 4, conveyor band 11 may be provided at the stacking station so that the stacks of sheets are deposited on the conveyor band and may be entrained thereby for removal to a designated location.

In the preferred embodiment illustrated in FIGS. 1 and 2, acurate sheet guide elements 17 surround a portion of the periphery of drum 12 and extend to the delivery end of conveyor bands 3, where one end of guide elements 17 is bolted to mounting block 26 which also carry bearings 24 for rollers 15. Sheet guide elements are spaced closely from the periphery of drum 12 and have a free end before stacking station 10 to enable successive sheets to fall from their pockets. The guide elements assist transfer of the successive sheets from discharge rollers 15 into pockets 6, as drum 12 continuously rotates by the rollers 15 and conveyor bands 3 deliver the sheets into the mouth of pockets 6, guided by elements 17. The guide elements will prevent the sheets from being thrown out of the pockets, as the drum continues rotating, but since these guide elements do not extend to the stacking station, stripper elements 7 will be able to strip the sheets from the pockets as the ends of sheets 4 are engaged by the stripper elements to hold them stationary while drum 12 continues rotating. In this way, the sheets will be pushed out of pockets 6 and automatically stacked at station 10.

Figure 3:
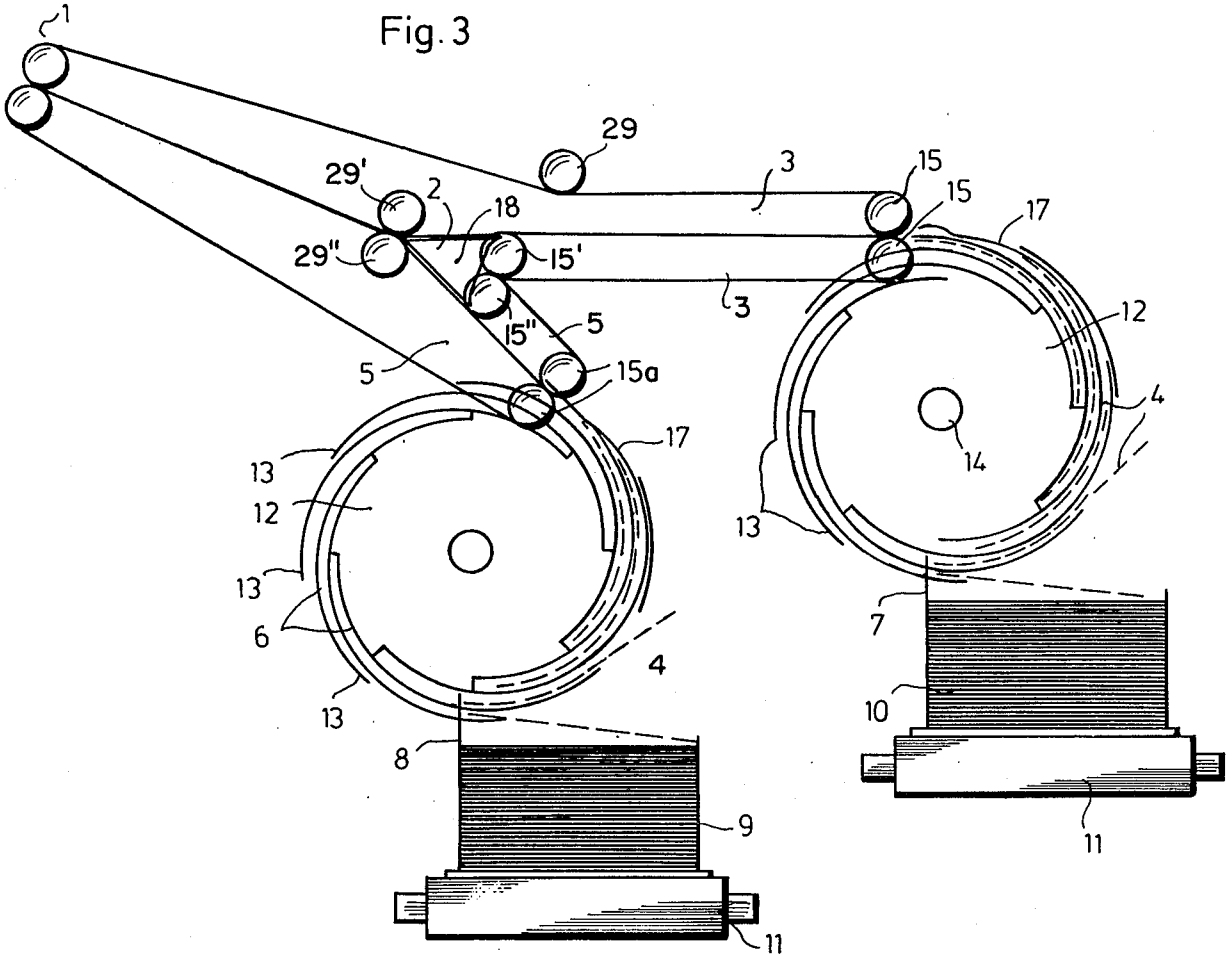
FIG. 3 is a somewhat schematic end view of an arrangement of two such drums mounted in series.
Figure 4:
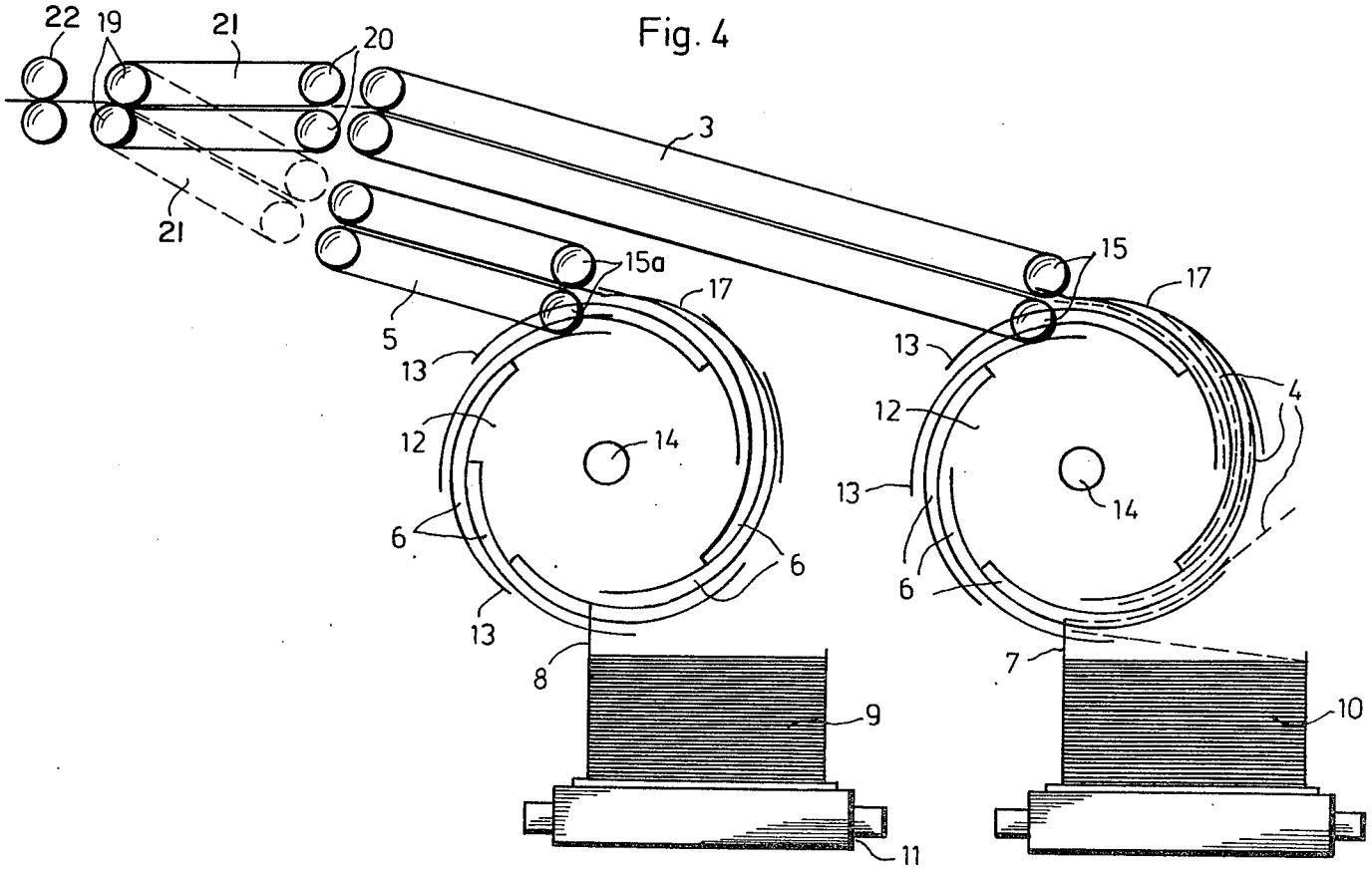
FIG. 4 is a like view, with a modified conveyor band means arrangement.

FIGS. 3 and 4 illustrate the apparatus of FIGS. 1 and 2 adapted for modified sheet delivery systems. In these embodiments, two drums 12 are arranged in series to form two stacking stations 9 and 10 which can be operated alternately or selectively. As shown in FIG. 3, upper conveyor band 3 is trained over rollers 1 and 15, guide rollers 29 and 29' determining the path of the conveyor band between end rollers 1 and 15. Lower conveyor band 3 is trained over end rollers 15 and 15', successive sheets 4 being conveyed to the drum between the cooperating conveyor bands to produce stacks 10. A second set of cooperating conveyor bands 5 is provided alternate feeding of second drum 12. Upper conveyor band 5 is trained over rollers **15*a* and 15'' while the lower conveyor band is trained over end rollers 1 and 15*a*, with intermediate guide roller 29'' for lower conveyor band 5 determining the path of this conveyor band and cooperating with guide roller 29' at a switching station. A pivotal switching bracket is mounted at the switching station to permit selective switching of sheets to conveyor bands 3 or 5. In the illustrated position of the switch, the sheets will be fed to conveyor bands 3 but if the switch is pivoted downwardly, the sheets will be delivered to conveyors 5. The switching bracket consists of a wedge-shaped deflector member pivotal aboit horizontal axis 18**.

In the embodiment of FIG. 4, the two sets of cooperating conveyor bands 3 and 5 are selectively fed by another set of cooperating conveyor bands 21 each of which is trained over rollers 19 and 20. Conveyor bands 21 receive successive sheets from feed rollers 22 and are pivotal between the positions shown, respectively, in full and broken lines to delivery the sheets either to cooperating conveyor bands 3 or to cooperating conveyor band 5.

In the embodiments of FIGS. 3 and 4, the stripper elements at stacking station 9 are designated by numeral 8.

What I claim is:

1. An apparatus for stacking sheets in a rotary printing press, which comprises the combination of (a) a conveyor band means having a delivery end for conveying successive ones of the sheets to the delivery end, (b) a sheet receiving drum mounted for rotation adjacent the delivery end of the conveyor band means, the drum comprising (1) a plurality of like axially spaced discs, each disc having a series of spirally extending, equidistant pockets distributed uniformly about the periphery thereof, each pocket defining an inlet opening for receiving a respective one of the sheets from the delivery end as the drum rotates successive ones of the inlet openings into sheet receiving relationship with the delivery end, the inlet openings of the pockets of all discs being in alignment, (c) stripper elements mounted peripherally spaced from the delivery end of the conveyor band means at a sheet stacking station and extending between the discs of the sheet receiving drum whereby an inner end of each successive sheet is stopped by the stripper elements as the drum rotates and brings the inner sheet end into engagement with the stripper elements and further rotation of the drum strips the successive sheets out of the pockets wherein they have been received and stacks the successive sheets, (d) sheet guide elements mounted between the discs and surrounding a substantial portion of the periphery of the drum and extending to the delivery end of the conveyor band means, the sheet guide elements ending before the stacking station to enable the successive sheets to fall from their pockets, and (e) a sheet guide element extending outwardly and tangentially to the drum at each inlet opening of the pockets, the sheet guide elements cooperating to provide closed pockets for the respective sheets during rotation of the drum from the delivery end to the stacking station.

2. The sheet stacking apparatus of claim 1, wherein the conveyor band means comprises two conveyor band arrangements each having a delivery end, one of said sheet receiving drums is mounted adjacent each of the delivery ends, and further comprising means for switching between the two conveyor band arrangements for delivering successive sheets to a selected one of the drums.

* * * * *